United States Patent [19]

Collins

[11] 3,973,163

[45] Aug. 3, 1976

[54] HEATER SUPPORT POSITIONING IN A CRT ELECTRON GENERATING ASSEMBLY

[75] Inventor: Floyd Keith Collins, Seneca Falls, N.Y.

[73] Assignee: GTE Sylvania Incorporated, Stamford, Conn.

[22] Filed: Sept. 2, 1975

[21] Appl. No.: 609,348

[52] U.S. Cl. ..... 313/417; 313/446

[51] Int. Cl.[2] ..... H01J 29/50; H01J 29/82

[58] Field of Search ..... 313/309, 314, 317, 446

[56] References Cited

UNITED STATES PATENTS

| | | | |
|---|---|---|---|
| 3,387,166 | 6/1968 | Kraner et al. | 313/417 X |
| 3,575,626 | 4/1971 | Blumenberg | 313/417 |

*Primary Examiner*—Robert Segal

*Attorney, Agent, or Firm*—Norman J. O'Malley; Frederick H. Rinn; Robert T. Orner

[57] ABSTRACT

An improvement is provided in a plural beam cathode ray tube electron gun assembly wherein positive positioning and embedment of the heater support means is achieved. One of a plurality of heater support means is oriented in each of a plurality of longitudinal rods supporting the gun assembly, in the area intervening between the embedded termini of two adjacently positioned cathode assembly support means positioned in side-by-side relationship. During gun assembly fabrication, localized movement of the softened glass of the rod, is restricted between the termini thereby effecting improved embedment of the heater support therebetween.

3 Claims, 3 Drawing Figures

HEATER SUPPORT POSITIONING IN A CRT ELECTRON GENERATING ASSEMBLY

CROSS REFERENCE TO RELATED APPLICATION

This application contains matter disclosed but not claimed in a related United States Patent application filed concurrently herewith and assigned to the assignee of the present invention. This related application is S.N. 609,347, filed Sept. 2, 1975 Attorney's Docket D-8579.

BACKGROUND OF THE INVENTION

This invention relates to a plural beam cathode ray tube electron generating assembly and more particularly to an improvement in the means for supporting the heater elements in a plural beam electron gun construction.

In plural beam cathode ray tube electron generating assemblies, wherein the cooperating gun structures are oriented in either in-line or delta arrangement, it has been conventional practice to embed the heater support elements in the longitudinal insulative rod-like support members utilized to integrate the related electrode elements into the respective electron gun structures of the assembly. These longitudinal support members are formed of a material, such as glass, which is selectively softened during fabrication of the assembly to facilitate afixal embedment of structural support means therein. Since the heater supports are usually the most rearward positioned support structures in the assembly, they are accordingly oriented as separate isolated elements near the ends of the insulative support rods. Unlike other electron gun elements, the heater support elements are usually small structures, and as such are difficult to firmly support in a positioning fixture during the embedding operation. Thus, the separate heater supports frequently evidence a tendency to shift during their insertion into the respective insulative rods, a condition which often results in loose and mislocated positionings of these elements. The insertion of the single heater support element into an area of the softened insulative rod during the embedment procedure, usually produces a rolled flow of glass on either side of the element, thereby effecting reentrant spacings on either side therealong which are deleterious to the achievement of secure embedment.

OBJECTS AND SUMMARY OF THE INVENTION

It is an object of the invention to reduce the aforementioned disadvantages evidenced in a plural beam cathode ray tube electron generating assembly. Another object is to provide positive embedment of the heater support means in the assembly.

The environment of the invention is a plural beam cathode ray tube electron generating assembly which incorporates a plurality of structurally related electron guns. The assembly is integrated by a plurality of spatially oriented longitudinal insulative rod-like members which are arranged to support the several electrode elements forming each of the associated guns therein. Included within the assembly are a plurality of separate metallic cathode assembly positioning members each having outstanding extremital portions wherefrom configurated termini extend in a common plane. For example, in the rearward portion of each of the rod-like supporting members there are usually two of these termini, one from each of two adjacent cathode assembly positioning members, which are embedded therein in a spatially related side-by-side manner. The invention relates to an improvement wherein the heater support members are discretely positioned to effect optimized embedment in the insulative glass support rods. Each heater support member is formed to have a terminally contoured planar projection portion which is embedded in a respective support rod in substantially the plane of embedment of the aforementioned termini of the cathode positioning members affixed therein. The discrete orientation of each of the planar projection portions of the heater support means is in the intervening area of the rod between the side-by-side embedment of the respective related termini of two of the cathode assembly positioning members, wherebetween the localized flow of softened glass is restricted. Thus, there is effected improved individual embedment of each heater support member in a respective glass supporting member.

DESCRIPTION OF THE PREFERRED EMBODIMENT

Figure 1:
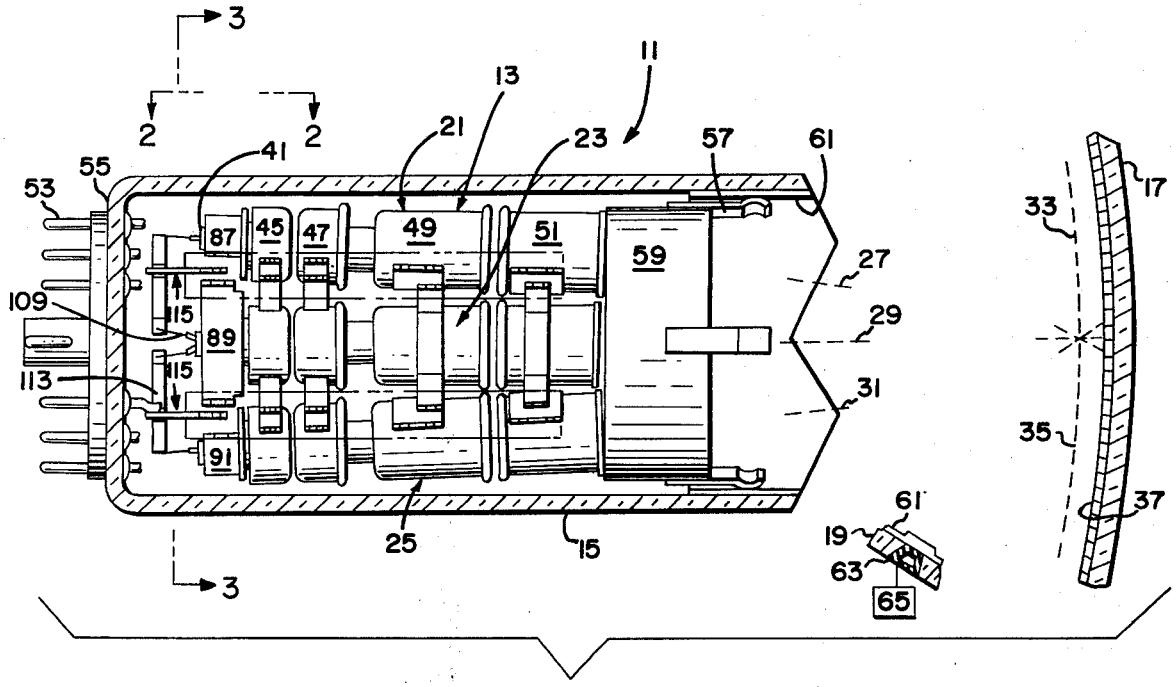
FIG. 1 is a partial plan view illustrating the neck section, the electron generating assembly, and screen portion of a plural beam color cathode ray tube embodying the features of the invention.

For a better understanding of the present invention, together with other and further objects, advantages, and capabilities thereof, reference is made to the following specification and appended claims in connection with the aforedescribed drawings.

While the invention is described in relationship to a plural beam electron generating assembly employing an in-line arrangement of related electron guns, it is also applicable to an assembly having a delta arrangement of electron gun structures.

With reference to the Figures, there are shown pertinent portions of a typical plural beam color cathode ray tube 11 embodying an electron generating assembly 13 employing an in-line arrangement of related electron guns. The neck portion 15 of the glass envelope is suitably connected to an oppositely disposed viewing panel or faceplate portion 17 by an intermediate funnel portion 19, which is not detailed. Within the neck portion there is positioned the exemplary plural beam electron generating assembly having three individual multi-electrode gun structures, 21, 23 and 25, oriented in an in-line arrangement. Each of the guns generates an individual beam of controlled electrons, 27, 29 and 31, which are directed to converge at the plane of the apertured mask 33, whereupon the individual beams pass through the holes or apertures 35 formed therein to impinge discrete areas of the patterned phosphor screen 37 disposed upon the interior surface of the viewing panel 17 of the tube. The impingement of the electrons effects luminescent excitation of selected areas of the screen, such being manifest as a visual display of color imagery.

Each of the individual electron guns is formed of a plurality of related electrodes arranged in a sequential order. For example, the construction of gun 21 is an integration comprised of a cathode assembly structure 39, which includes a cathode sleeve 41 and a cathode shielding eyelet 43, a first or control electrode 45, and second 47, third 49, and fourth 51 electrodes respectively. The electrical connections for the individual electrodes with the exception of the terminal electrode, are consummated by a plurality of connectors 53 hermetically sealed in the base end 55 of the tube. For purposes of clarity, the individual internal electrode connections are not shown. In the case of the terminal electrode 51, electrical connection is made through a plurality of snubber elements 57 which are affixed to the terminal cup assembly 59, thereby effecting electrical contact with the internal conductive coating 61 disposed on the upper part of the neck portion 15 and extending therefrom over the interior surface of the funnel 19, a section of which is shown. A high voltage connective means 63 hermetically traverses the aforementioned funnel portion to connect the internal conductive coating to an external source of potential 65.

As shown in the Figures, the electron generating assembly utilizes four spatially related longitudinal insulative rod-like members, 67, 69, 71 and 73, formed of a material such as glass, which are arranged in pairs, 67, 69 and 71, 73, on either side of the central plane "*a*" of the in-line gun arrangement wherein configurated attachment means 75, are embedded to support the plurality of aforementioned related electrode elements forming each of the in-line gun structures.

Figure 2:
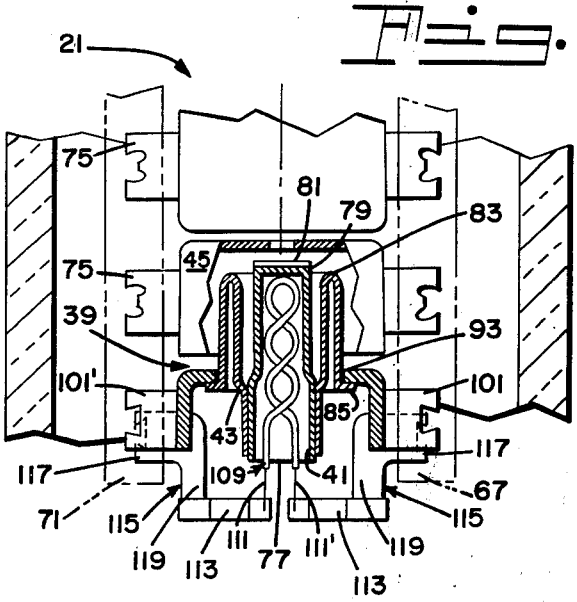
FIG. 2 is an enlarged sectional view of a portion of the electron generating assembly taken along the plane 2—2 of FIG. 1.
Figure 3:
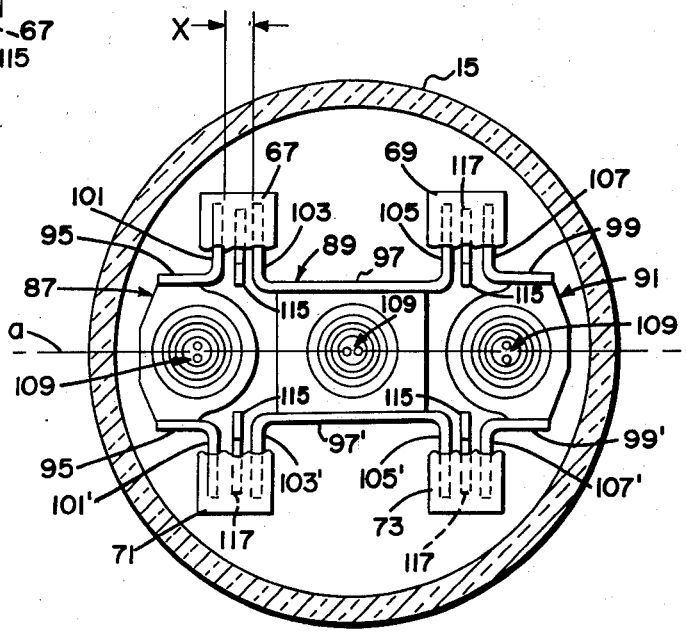
FIG. 3 is an enlarged plan view of a section of the electron generating assembly taken along the plane 3—3 of FIG. 1, further amplifying the structural details of the invention.

With particular reference to FIGS. 2 and 3, the cylindrical cathode sleeve 41 has an open end 77 and an oppositely closed end 79, the outer surface of which has a layer of electron emissive material 81 disposed thereon. The open end of the sleeve is affixed in a compatibly dimensioned portion of a cathode shielding eyelet 43 which is a dual-dimensioned structure having an overall length shorter than that of the cathode sleeve. Embodiments of this type of eyelet are disclosed by A. T. Kuryla in U.S. Pat. No. 3,351,792, which is assigned to the assignee of the present invention. In the present instance, as shown in FIG. 2, the exemplary dual-dimensioned cathode shielding eyelet 43 has a substantially cylindrical upper portion formed as a dual-wall structure 83 fashioned from an inner wall doubled backed on itself in an outward inverse manner to form a related outer wall. The extremital portion of this outer wall is formed in an outstanding manner to provide a substantially circular seating projection 85 oriented intermediate to the open ends of the eyelet.

The respective all-metal shielded cathode assemblies are supported by first 87, second 89 and third 91 cathode positioning members which individually have apertures, such as 93, formed therethrough of a size to accommodate placement and affixation of the seating portions 85 of the respective cathode assemblies therein. Each of the cathode positioning members has related side members, 95, 95′, 97, 97′, 99, 99′, extending as skirt-like walls from the respective base sections thereof. Projecting from these walls are extremital portions, 101, 101′, 103, 103′, 105, 105′, 107, 107′, with configurated termini which, extending therefrom, are embedded in the rearward portions of the related rod-like supporting members of the assembly 13. For example, two separated termini, such as 101 and 103, one from each of two adjacent cathode assembly positioning members 87 and 89, are embedded therein in a spatially related side-by-side manner. It is to this environment that the invention is introduced.

A conventional heating element 109 is positioned within each of the cathode sleeves 41 through the open end 77 thereof to provide the necessary operational temperature thereto. Each leg 111, 111′ of the heating element 109 is bonded to a heater connective structure 113 which may be formed as either a series or parallel arrangement according to the requirements of the tube. The heater connector structure 113 is in turn affixed to a plurality of individual heater support members 115, each of which has a terminally contoured planar projection portion 117 embedded in each of the rod-like glass supporting members, 67, 69, 71, 73, in substantially the plane of embedment of the termini 101, 101′, 103, 103′, 105, 105′, 107, 107′, of the respective cathode positioning members. The attachment portions 119 of the heater support means 115 extends angularly from the embedment portion 117 to facilitate location of the structural connective means 113 affixed thereto.

With particular reference to FIG. 3, the planar projection portions 117 of the heater support members 115 are embeddingly oriented in the intervening area "*x*" existant between the side-by-side embedment of the respective related termini of two of the cathode assembly positioning members; as for example, termini 101 and 103 of cathode positioning members 87 and 89. In each instance, the two adjacently related termini provide restrictive means for confining the flow of the softened glass, thereby effecting improved embedment of the projection portion 117 inserted therebetween During assembly fabrication, the confinement of the heat-softened glass between the respective termini, minimizes the rolling-flow of plastic glass resultant from the insertion of the respective termini thereinto, and thereby reduces the formation of re-entrant spacings relative to the several termini. Therefore, improved embedment is realized for all three projections involved in the confined area of each of the supporting rods.

Additional benefits are realized from positioning the heater support members as aforedescribed. One such advantage is manifest by the improved shielding of the intervening area between adjacent embedded termini afforded by the positioning of the extra projecting member therebetween. Another benefit is the realization of a shorter assembly structure which is a distinct advantage in those instances where a compaction of the gun structure is desired.

Thus, there is provided an improved electron generating assembly wherein enhanced embedment of the heater support elements is achieved, and wherein additional shielding of the space intervening between the embedded termini of the cathode assembly support means has been efficiently provided.

While there has been shown and described what is at present considered the preferred embodiment of the invention, it will be obvious to those skilled in the art that various changes and modifications may be made therein without departing from the scope of the invention as defined by the appended claims.

What is claimed is:

1. An improvement in a plural beam cathode ray tube electron generating assembly incorporating a plurality of structurally related electron guns, said assembly utilizing a plurality of spatially oriented longitudinal glass rod-like members arranged to support the several electrode elements forming each of said electron guns, wherein said assembly includes a plurality of separate metallic shielded cathode assembly positioning members having outstanding extremital portions wherefrom configurated termini extend in a common plane, each of said rod-like supporting members having embedded therein a terminus of each of two adjacent cathode assembly positioning members in a spatially related side-by-side manner, each of said cathodes having a separately supported individual heating element oriented therein, said improvement relating to discretely positioned heater support means comprising:

a plurality of planar, strap-like heater support members each having a terminally contoured planar projection portion embedded in each of said rod-like members in substantially the plane of embedment of the termini of said cathode positioning members, each of said planar projection portions being embeddingly oriented in the intervening area between the side-by-side embedment of the respective related termini of two of said cathode assembly positioning members to effect improved individual embedment of each heater support member in a respective glass supporting member.

2. The improvement in the discretely positioned heater support means according to claim 1 wherein each of said heater support members if formed as a substantially planar element having an attachment portion extending angularly from said embedment portion, said attachment portion having structural connective means affixed thereto to effect connective-support for the heater elements in said electron generating assembly.

3. The improvement in the discretely positioned heater support means according to claim 1 wherein the depth of embedment of said projection portion is substantially equal to that of the two adjacently related termini.

* * * * *

UNITED STATES PATENT AND TRADEMARK OFFICE

CERTIFICATE OF CORRECTION

PATENT NO. : 3,973,163
DATED : August 3, 1976
INVENTOR(S) : Floyd Keith Collins

It is certified that error appears in the above-identified patent and that said Letters Patent are hereby corrected as shown below:

Col. 6, Claim 2, line 3 - Please delete "if" and insert -- is --.

Signed and Sealed this

Nineteenth Day of October 1976

[SEAL]

*Attest:*

RUTH C. MASON
*Attesting Officer*

C. MARSHALL DANN
*Commissioner of Patents and Trademarks*